US006508351B1

(12) United States Patent
Christoffersen et al.

(10) Patent No.: US 6,508,351 B1
(45) Date of Patent: Jan. 21, 2003

(54) METHOD AND APPARATUS FOR ORIENTING FLEXIBLE WALLED ARTICLES

(75) Inventors: Johnny Martin Bogedahl Christoffersen, Bromsgrove (GB); David William Payne, Leicestershire (GB)

(73) Assignee: Ishida Co., Ltd., Kyoto (JP)

( * ) Notice: Subject to any disclaimer, the term of this patent is extended or adjusted under 35 U.S.C. 154(b) by 43 days.

(21) Appl. No.: 09/705,886

(22) Filed: Nov. 6, 2000

(30) Foreign Application Priority Data

Nov. 9, 1999 (GB) ..... 9926555

(51) Int. Cl.[7] ..... B65G 47/24
(52) U.S. Cl. ..... 198/394; 198/401; 198/399
(58) Field of Search ..... 198/394, 395, 198/399, 401, 398, 400; 382/296, 297

(56) References Cited

U.S. PATENT DOCUMENTS

| | | | | |
|---|---|---|---|---|
| 3,592,326 A | * | 7/1971 | Zimmerle et al. | 198/394 |
| 4,147,930 A | * | 4/1979 | Browne et al. | 198/394 |
| 4,435,837 A | * | 3/1984 | Abernathy | 112/275 |
| 4,940,128 A | | 7/1990 | Fuller, Jr. et al. | 198/395 |
| 5,182,647 A | * | 1/1993 | Chang | 348/243 |
| 5,204,913 A | * | 4/1993 | Morooka et al. | 382/111 |
| 5,924,546 A | * | 7/1999 | Funaya | 198/395 |
| 6,328,523 B1 | * | 12/2001 | Watanabe et al. | 198/396 |

FOREIGN PATENT DOCUMENTS

| | | |
|---|---|---|
| EP | 0273785 | 7/1988 |
| EP | 0613841 A1 | 9/1994 |
| GB | 1507365 | 4/1978 |
| GB | 2327929 A | 2/1999 |
| WO | WO 90/01010 | 2/1990 |

OTHER PUBLICATIONS

Great Britain Search Report for Application No. GB 9926555.5 dated Feb. 3, 2000.

* cited by examiner

*Primary Examiner*—Christopher P. Ellis
*Assistant Examiner*—Richard Ridley
(74) *Attorney, Agent, or Firm*—Staas & Halsey LLP

(57) ABSTRACT

A method and apparatus for orienting a flexible walled article, such as a pillow type bag. With the method and apparatus, the article is presented to a pattern detector which detects a pattern on the surface of the article. The detected pattern is compared with at least one of a number of predetermined patterns representing respective orientations of the article, to identify the orientation of the presented article. When the identified orientation is not a required orientation, the article is automatically turned in a manner dependent on the identified orientation so that the article takes up the required orientation.

59 Claims, 7 Drawing Sheets

1. RIGHT WAY UP, RIGHT WAY ROUND;
2. RIGHT WAY UP, TURNED 90 DEGREES;
3. RIGHT WAY UP, TURNED 180 DEGREES;
4. RIGHT WAY UP, TURNED 270 DEGREES;
5. WRONG WAY UP, RIGHT WAY ROUND;
6. WRONG WAY UP, TURNED 90 DEGREES;
7. WRONG WAY UP, TURNED 180 DEGREES;
8. WRONG WAY UP, TURNED 270 DEGREES.

FIG. 4

| INITIAL CONDITION | ACTIVATE DEVICE 20? | ACTIVATE DEVICE 21? | ACTIVATE DEVICE 22? |
|---|---|---|---|
| RIGHT WAY UP, RIGHT WAY ROUND | NO | NO | NO |
| RIGHT WAY UP, TURNED 90 DEGREES | YES | NO | NO |
| RIGHT WAY UP, TURNED 180 DEGREES | NO | YES | YES |
| RIGHT WAY UP, TURNED 270 DEGREES | YES | YES | YES |
| WRONG WAY UP, RIGHT WAY ROUND | NO | YES | NO |
| WRONG WAY UP, TURNED 90 DEGREES | YES | YES | NO |
| WRONG WAY UP, TURNED 180 DEGREES | NO | NO | YES |
| WRONG WAY UP, TURNED 270 DEGREES | YES | NO | YES |

FIG. 5

METHOD AND APPARATUS FOR ORIENTING FLEXIBLE WALLED ARTICLES

CROSS-REFERENCE TO RELATED APPLICATIONS

This application is based on, and claims priority to, British patent application number 9926555.5, filed Nov. 9, 1999, and which is incorporated herein by reference.

BACKGROUND OF THE INVENTION

1. Field of the Invention

The present invention relates to a method and apparatus for orienting flexible walled articles, for example, of the pillow bag type such as snack packs.

2. Description of the Related Art

Many food stuffs, particularly snacks, are packaged in flexible walled articles which are then loaded into larger cartons or the like for transportation. Recently, transparent "cartons" have been developed into which the snack packs are loaded for sale as complete cartons. In this case, it is desirable to ensure that each pack is oriented in the same way within the carton both for aesthetic reasons and to enable a purchaser to view at least part of the packs through the wall of the carton. It is also helpful in other applications to ensure that the packs are loaded into cartons in the same orientation for ease of checking that there are no rogue packs of a different type.

Up until now, this process has been largely manual with a human packer receiving a sequence of packs for manually loading into cartons. Recently, a device was disclosed which can distinguish between a "landscape" or "portrait" orientation of a rectangular pack and then rotate it to a required orientation automatically. However, this overlooks or ignores the fact that a typical rectangular pack will have printing on each side and so can take up more than one portrait or landscape orientation. In particular, packs typically carry marking which differ between the front and back of the pack.

SUMMARY OF THE INVENTION

Accordingly, it is an object of the present invention to provide a method and apparatus for efficiently and effectively orienting flexible walled articles.

Additional objects and advantages of the invention will be set forth in part in the description which follows, and, in part, will be obvious from the description, or may be learned by practice of the invention.

Accordingly, objects of the present invention are achieved by providing a method and apparatus for orienting flexible walled articles. In the method and apparatus, the orientation of a pattern on the article is detected. Then, the detected pattern is used to control any required turning process for turning the article. Thus, the present invention does not rely simply on detecting the physical orientation (for example, portrait or landscape) of the article, but upon the orientation of the pattern. In this way, articles which would appear to conventional systems to have the same orientation, but which in fact are reversed or upside down, can be distinguished.

Surprisingly, according to embodiments of the present invention, it has been determined that sufficiently accurate pattern recognition can be performed despite the fact that the article has flexible walls and thus is not guaranteed to present its surface to a pattern detector in exactly the same way on every occasion.

A variety of pattern matching techniques can be used. In one approach, according to an embodiment of the present invention, the pattern over the entire surface of the article facing the pattern detector is determined, for example, using a CCD camera. This determined pattern is then compared with a set of predetermined patterns to determine the orientation of the article.

In other approaches, however, each pattern is defined by the appearance of a number of image areas along the presented surface of the article. Thus, the pattern detected may only be a portion of the overall pattern since it has been found that this is often sufficient to distinguish between the different orientations of the article. This is particularly so if there are only a limited number of possible orientations, such as four or eight, which will usually be the case. Furthermore, according to an embodiment of the present invention, some very simple pattern matching processes have been developed, particularly for snack packs, which can be performed very quickly to thereby enable fast processing speeds to be achieved of, for example, one-hundred-twenty (120) articles per minute or more.

According to embodiments of the present invention, two primary techniques have been developed for comparing the detected pattern with predetermined patterns. In one technique, the appearance of each image area is defined by more than one channel of data, each channel representing a different characteristic of the appearance of the image area. One or more of these channels can then be used to make a comparison with the corresponding channel of a predetermined pattern. Conveniently, this comparison is achieved by simply determining the difference between the data values of the two sets and summing the differences.

In another approach, a comparison can be performed by combining the channels into a single channel and then comparing the single channel with each corresponding single channel of each predetermined pattern.

An orientation system could be provided by a single orientation device which is operable to carry out whichever turning operation(s) is(are) required. For example, the article could be fed to a robotic device. Alternatively, however, the orientation system may comprise a first orientation device for imparting a 90° lateral rotation to the article, a second orientation device for imparting a 180° side to side rotation to the article, and a third orientation device for imparting a 180° end to end rotation. Separating the orientation system into three devices allows the article to be fed through the apparatus substantially continuously by a conveyor or the like.

The second orientation device could comprise a double twisted band utilized with a bypass path so that if a side to side rotation is not required, the article is not fed to the band. The third orientation device could comprise an abutment such as one or more fingers which can be selectively positioned in the path of the article, and a pushing device for flipping the article over the abutment.

Embodiments of the present invention are particularly applicable to articles of the pillow bag type such as, for example, snack packs containing, for example, potato chips, hula hoops and the like. These types of packs are typically created by a form-fill sealing machine such as, for example, a vertical form-fill sealing machine. An Apex packaging machine manufactured by Ishida Co., Ltd, is an example of such a machine.

BRIEF DESCRIPTION OF THE DRAWINGS

These and other objects and advantages of the invention will become apparent and more readily appreciated from the following description of the preferred embodiments, taken in conjunction with the accompanying drawings of which:

FIG. 4 is a table illustrating various orientations of an article, according to an embodiment of the present invention.

FIG. 5 is a table defining the activation of various orientation devices, according to an embodiment of the present invention.

DESCRIPTION OF THE PREFERRED EMBODIMENTS

Figure 1:
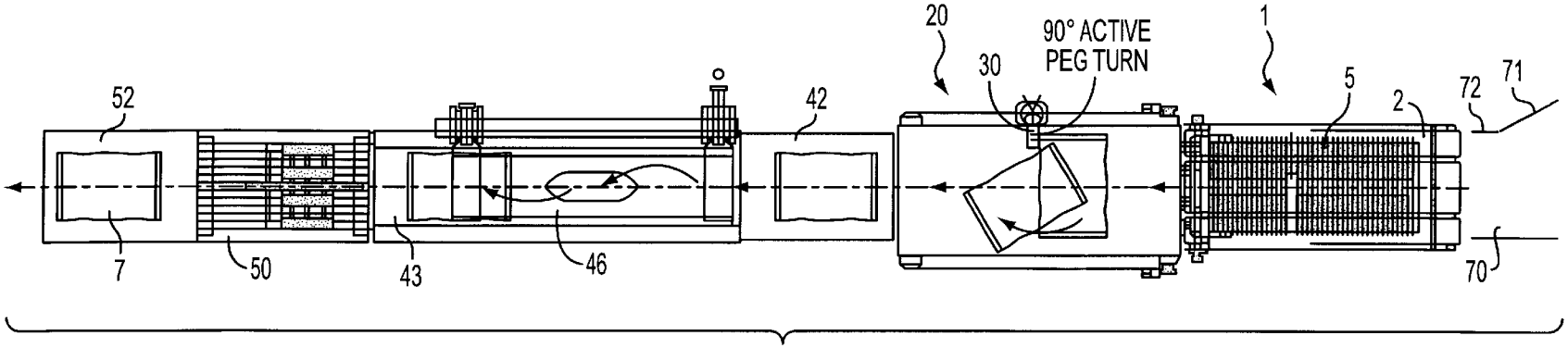
FIG. 1 is a plan view of an apparatus, according to an embodiment of the present invention.

Reference will now be made in detail to the present preferred embodiments of the present invention, examples of which are illustrated in the accompanying drawings, wherein like reference numerals refer to like elements throughout.

Figure 2:
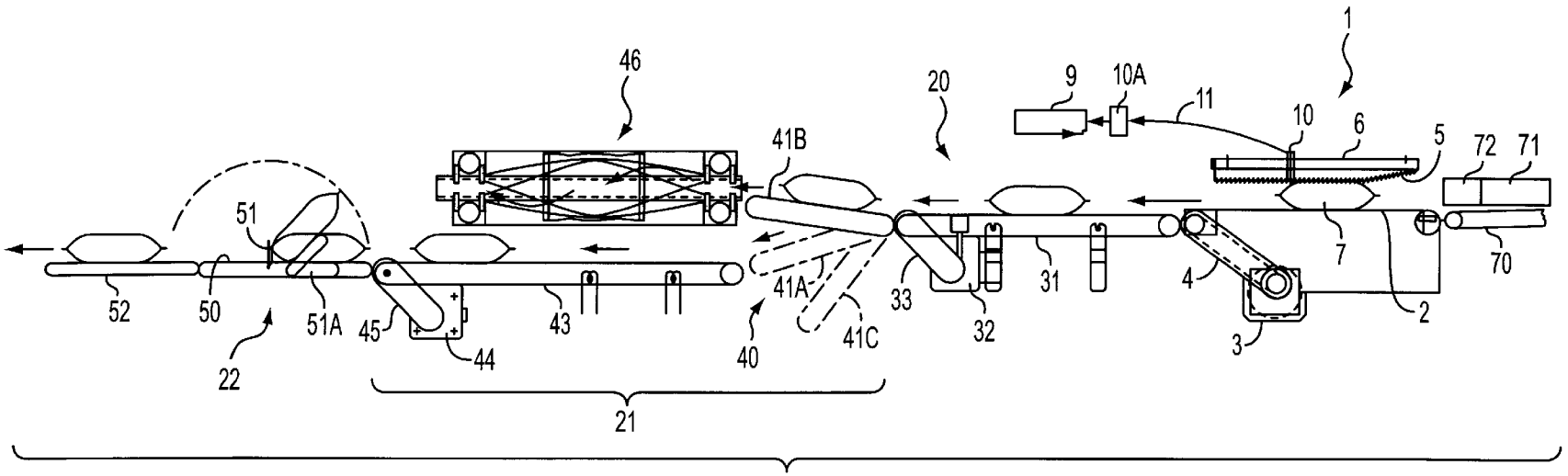
FIG. 2 is a side view of the apparatus in FIG. 1, according to an embodiment of the present invention.
Figure 3:
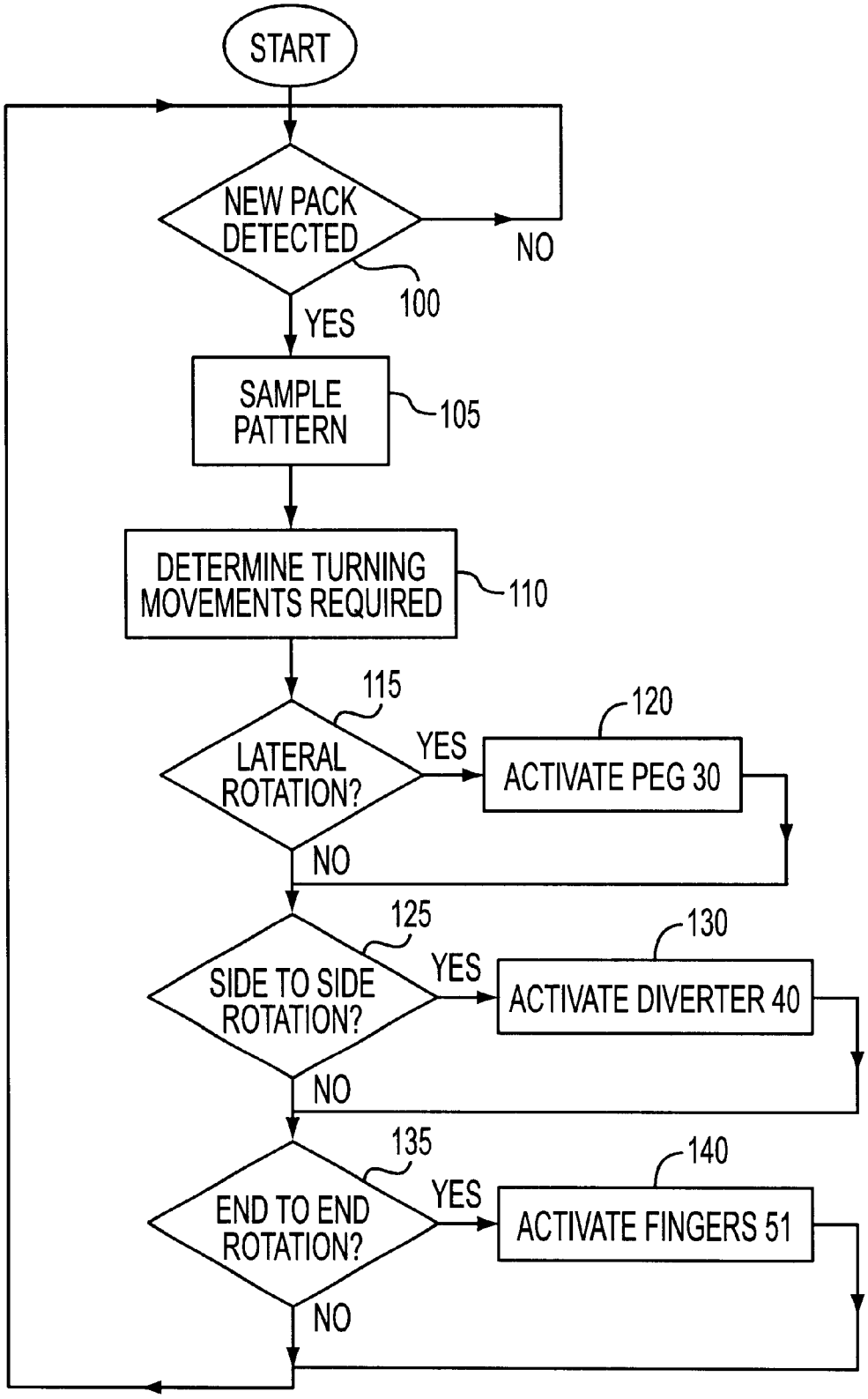
FIG. 3 is a flow diagram illustrating operation of the apparatus of FIGS. 1 and 2, according to an embodiment of the present invention.

Referring now to FIGS. 1, 2 and 3, the apparatus comprises a pack conditioning/detecting system 1 which receives snack packs of the pillow bag type from an intermediate bulk store (not shown) from which they are unscrambled into single file and fed continuously via a conveyor 70 in random orientations. The conveyor 70 feeds packs against a guide wall 71 which defines a datum 72 along which the packs are fed into the system 1.

The system 1 comprises a conveyor belt 2 driven by a motor 3 via a drive belt 4 to feed the packs at, for example, about 60 m/min. Located above the conveyor belt 2 is a set of rollers 5 mounted on a self leveling support 6 which gently squashes a pack 7, as can be seen in FIG. 2, while it is fed forward by the conveyor belt 2. A microprocessor 9 is connected to a color/contrast sensor 10A such as, for example, a Wenglor FBO1 which receives optical signals from a fiber optic cable 11 having an end 10 facing the packs at a sensing position. This cable 11 also carries light from a white light source (not shown) to the sensing position. The end 10 of the fiber optic cable 11 is mounted, for example, above a slot defined between a pair of the rollers 5 and will be spaced from the facing surface of a pack 7 as it passes by. Thus, the sensor 10A will "see" a diffused image of the pack surface and thus be less susceptible to minor variations in the lateral position and/or surface appearance of the pack. Sensor 10A is described as being, for example, a Wenglor FBO1. Of course, the present invention is not limited to this specific sensor, or this specific type of sensor, and other types of sensors can be used. Moreover, the specific positioning of the sensor described herein is intended as an example, and the present invention is not limited to this specific positioning.

The output from the sensor 10A is scanned by the microprocessor 9 at, for example, a nominal but variable rate of 1 kHz for a nominal but variable duration of 150 ms (giving a nominal but variable number of 150 samples). Each sample includes, for example, three values corresponding to three separate channels, namely blue/green, red/green, and grey (contrast). If the conveyor belt 2 is run, for example, at 60 m/min, sampling will be once per millimeter. These 3×150 data values are stored by the microprocessor 9 for subsequent processing. (The Wenglor FBO1 color/contrast sensor provides 3 0-10V analog outputs that are linear to the amount of the color/contrast that the sensor sees. These outputs are fed to an analog to digital convertor (not shown) controlled by the microprocessor 9).

The microprocessor 9 can distinguish, for example, between a background, when no pack is present at the sensing portion, and a pack present condition. When a pack is detected (operation 100, FIG. 3), the microprocessor 9 begins to accumulate data from the sensor 10A (operation 105, FIG. 3).

From the received data, the microprocessor 9 determines the orientation of the pack. The method of determining that orientation will be described below. But, as an example, the pack can initially have one of eight different orientations, as shown in the table illustrated in FIG. 4.

Having determined the current orientation, the microprocessor 9 determines what turning movements are required to bring the pack to a desired final orientation which will be the same for each pack (operation 110, FIG. 3). To effect this reorientation, a first orientation device 20, a second orientation device 21 and a third orientation device 22 would typically be provided in sequence downstream of the system 1.

The first orientation device 20 is for turning the pack between a long side leading orientation to a short side leading orientation. In the case of a square pack, these sides would be of equal length. If this rotation is required (operation 115, FIG. 3), the microprocessor 9 activates a peg 30 (operation 120, FIG. 3) at the side of the first orientation device 20 where it is rotated from a rest position parallel with the direction of movement of the pack 7 (not shown) to an active position shown in FIG. 2. In the active position, as the pack 7 is fed by a conveyor 31 (driven by a motor 32 via a drive belt 33), the comer of a long side leading edge will engage the peg 30 so that with the conveyor 31 driving the pack, the pack rotates laterally through 90° as shown in FIG. 1 to a short side leading orientation.

The pack is then fed to the second orientation device 21 which comprises, for example, an input conveyor belt 40 which can be moved by the microprocessor 9 between, for example, three positions 41A, 41B and 41C. More specifically, when in position 41(A), the system acts as a diverter by feeding a pack 7 to a bypass conveyor 43 driven by a motor 44 via a drive belt 45. When in position 41B, the system causes a pack 7 to be fed to a double twisted band 46 also driven by the motor 44. When in position 41C, the system is in a reject position for rejecting packs not recognized by the microprocessor 9. If a side to side rotation or twist is required (operation 125, FIG. 3), the belt 40 is moved to the position 41B (operation 130, FIG. 3) and the band 46 imparts a side to side 180° rotation to the pack 7. Following its passage through the band 46, the pack will exit down onto the conveyor belt 43.

The pack is then transferred by the conveyor belt 43 to the third orientation device 22 which comprises, for example, a set of conveyor belts 50 and interleaved fingers 51 which are reciprocable between a rest position (not shown) in which they lie under the upper run of the belts 50 and a turning position (shown in FIG. 2) in which they protrude upwardly in the path of the pack 7 to form an abutment. If an end to end rotation is required (operation 135, FIG. 3), the fingers 51 are moved upwards (operation 140, FIG. 3) so that the pack 7 is brought into engagement with the fingers 51. Further, fingers 51A forming an actuator are then rotated upwards to rotate the pack through 180° in an end to end manner over the fingers 51. (It will be appreciated that the forward movement of the pack will stop for a moment during this process.) The pack 7 is then in its desired orientation and is supplied to a final conveyor belt 52 for feeding into, for example, a carton.

The microprocessor 9 includes, for example, a memory holding eight sets of master tables (master (0) to master (7)), each including, for example, three data tables with 150 entries. The result of the scan is, for example, a read table containing three data tables each with 150 entries, each data table corresponding to one of the three detection channels.

The master tables are initially set up, for example, by passing a sample pack through the system 1 eight times in a predetermined order as, for example, set out in the table illustrated in FIG. 4.

When a pack to be orientated is passed through the system 1, data values from the sensor 10A are entered into the read tables. As soon as all values have been read, data matching is started. The data matching works, for example, as follows:

1. Compare data values, from first to last entries, of the read tables with the same values in the first set of master tables. Add up the absolute differences (d).

$$E.g.\ d=d+abs(\mathrm{read}(m)(n)-\mathrm{master}(0)(m)(n));\ //m=0\sim2,\ n=0\sim149$$

where m is the channel number, and n is the sample number.

2. Repeat operation 1 for the other master tables (master (1) to master (7)), adding the differences to separate totals.
3. Compare the totals. The master table causing the lowest total is deemed to be the closest match, and the software orders the orientation devices to handle the pack as required.

FIG. 5 illustrates a table defining which of the first, second and third orientation devices 20, 21 and 22 are activated in each case.

Due to pack variations, the point of detection of the leading edges of the packs may vary slightly. Therefore, for example, the microprocessor 9 carries out a time shift compensation before carrying out the pattern analysis described above. This can be achieved, for example, by finding the best match for ten samples of data in a +/−10 ms band in each master pattern in order to find the best time shift. At each offset, the arithmetic difference between the data values of each input pixel and the corresponding data value of the stored master pattern pixel are determined and then these differences summed. The offset corresponding to the lowest sum is chosen for the subsequent comparison process.

In some cases, it may also be desirable for the software to apply an averaging filter to the input data which causes the patterns to be smoothed.

In the example described in FIGS. 1 and 2, each rotation was carried out by a separate orientation device 20, 21, 22. Modifications will be apparent to a person skilled in the art in which one or more of these rotations are carried out by the same device.

Figure 6:
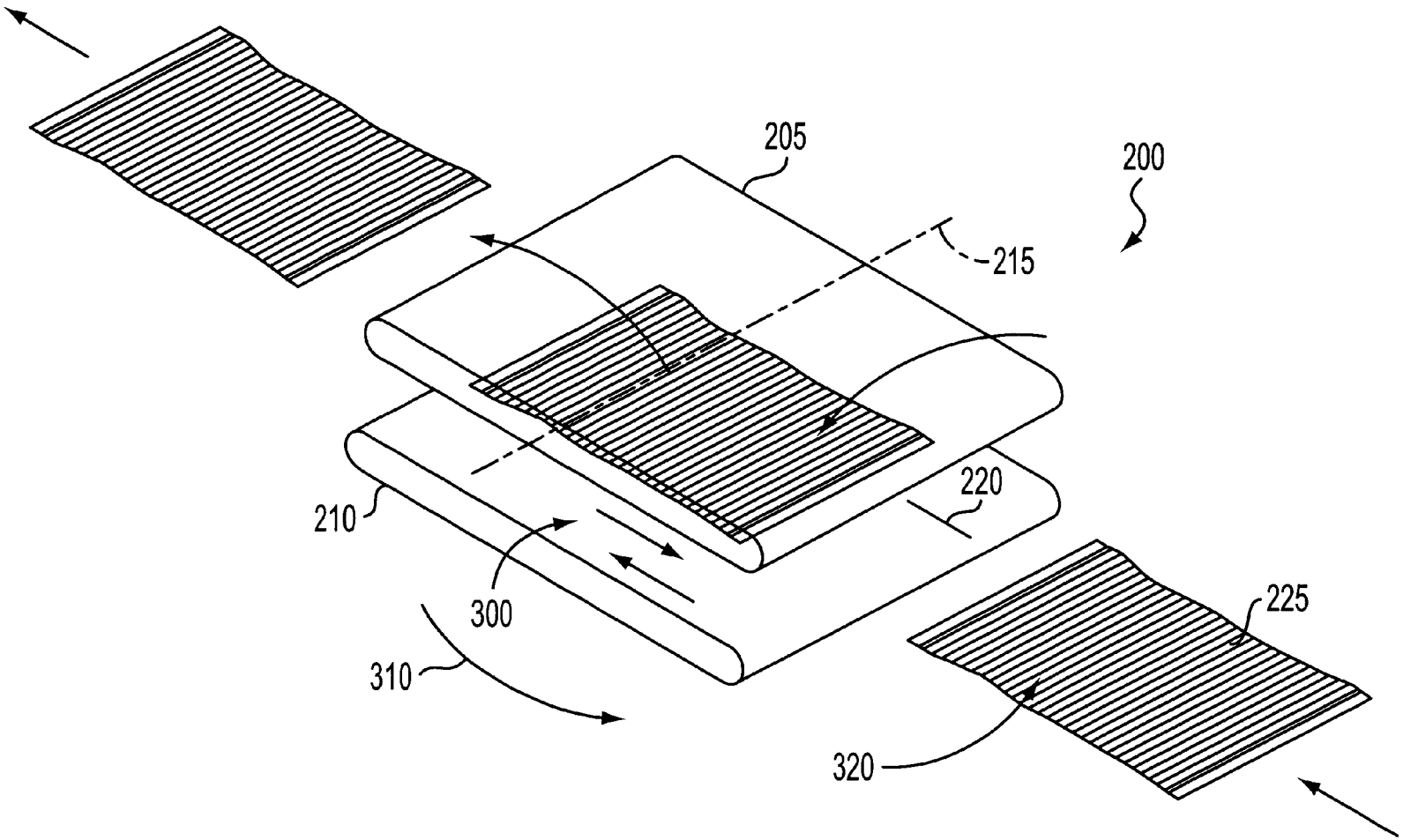
FIG. 6 is a schematic view of a modified form of the apparatus in FIG. 1 and 2, according to an additional embodiment of the present invention.

For example, FIG. 6 illustrates a device which can carry out a 180° end to end rotation and a 180° side to side twist. In FIG. 6, an orientation device 200 is shown which replaces orientation devices 21 and 22 of the previous example. In this case, the device comprises a pair of upper and lower conveyors 205, 210 which can be driven in either direction by a motor and clutch arrangement (not shown). The conveyors 205, 210 are mounted in a support structure (not shown) which can rotate about an axis 215 and an axis 220. Thus, when a pack 225 is fed between the conveyors 210, 215, it can then be turned from end to end in the same way as was effected by the orientation device 22 in the previous example or twisted laterally about the axis 220 in the same way as effected by the orientation device 21. In the case of an end to end rotation about the axis 215, the conveyors 205, 210 should be reversed to feed the pack out.

In FIG. 6, reference numeral 300 indicates that conveyors 205, 210 reverse direction after turning nose over tail to exit a pack that has been turned, and to accept a new pack. Reference numeral 310 indicates a nose over tail rotation. Reference numeral 320 indicates a side over side rotation.

In additional embodiments of the present invention, one or two of orientation devices 20–22 could simply be omitted. This will be feasible where the output side of the system does not care whether or not an article has a particular orientation in a particular sense.

Figure 7:
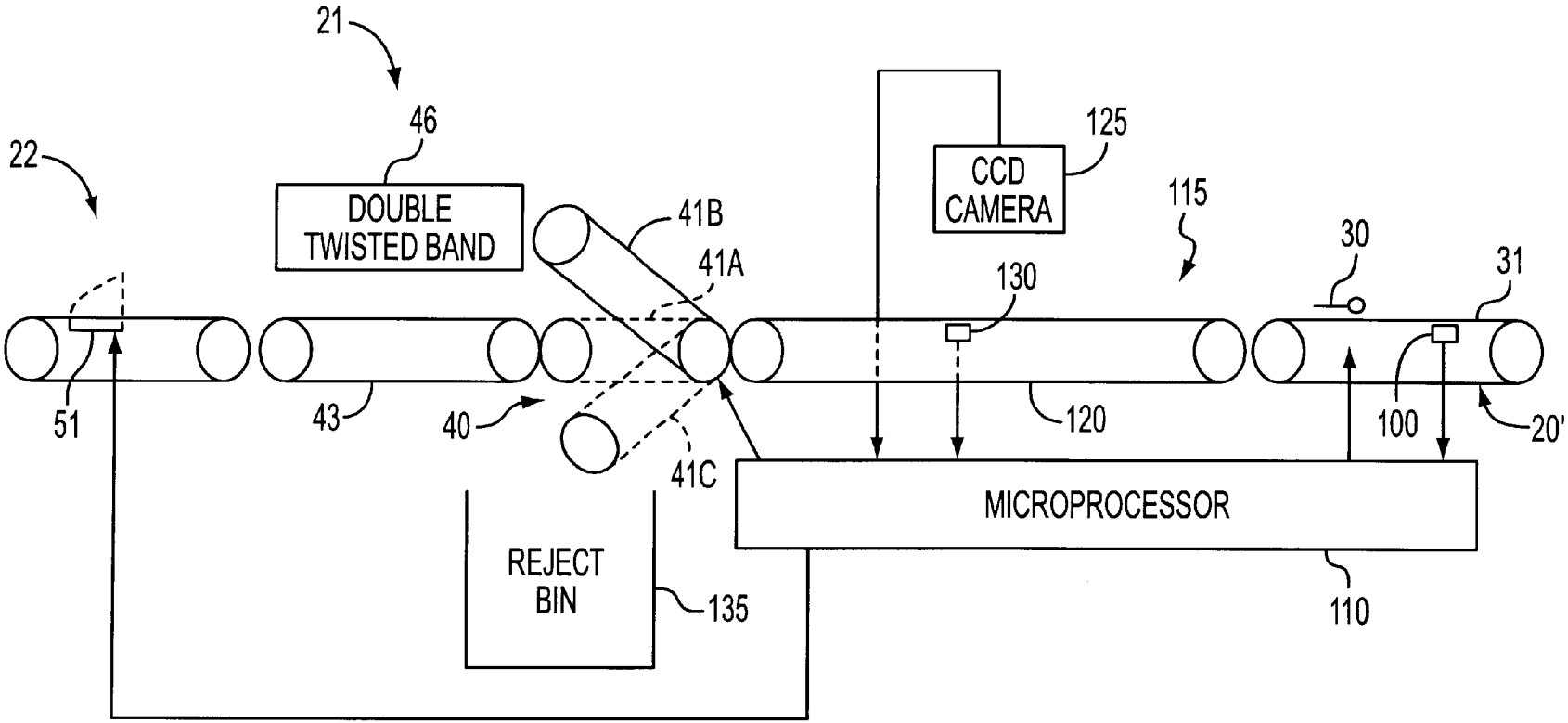
FIG. 7 is a plan view of an apparatus, according to a further embodiment of the present invention.

For example, FIG. 7 is a plan view of an apparatus, according to a further embodiment of the present invention. As in FIG. 1, a pack conditioning/detecting system will be provided, but this is omitted for clarity from FIG. 7. However, in this example, no sensor 10A is provided.

Referring now to FIG. 7, the system 1 feeds articles such as, for example, snack packs, to a first orientation device 20' which is identical with the first orientation device 20 except for the addition of a sensor 100. This sensor 100 is located, for example, laterally to one side of the path of the articles so as to detect articles which are being fed with their long edge leading in (in the case of rectangular articles). The sensor 100 is connected to a microprocessor 110 which responds to a signal from the sensor 100 indicating that an article has been detected to cause the peg 30 to rotate into the path of the article (as shown in FIG. 1) so that the article is reoriented with its short edge leading.

The pack is then fed to a detection stage 115 comprising a conveyor 120 with a CCD camera 125 located above the conveyor 120. This has, for example, integral LED lighting panels (not shown). As an example of a suitable camera is the Keyence CV-501 vision system. The camera 125 is connected to the microprocessor 110. Optionally a device can be located under the camera so as to help to square up packs just before they are viewed by the camera 125.

A sensor 130 is positioned relative to the conveyor 120 so as to detect the arrival of a leading edge of a pack and this is used, after a suitable delay to allow the pack to be centered beneath the camera 125, to trigger the camera 125. The camera 125 then takes a photograph of the entire facing surface of the pack (or a portion of the pack surface as appropriate). This image is digitized and fed to the microprocessor 110. The microprocessor 110 then compares the received image using conventional pattern correlation techniques with, for example, four reference images corresponding to the four possible orientations of the pack. These orientations correspond, for example, to orientations 1, 3, 5 and 7 in FIG. 4. The microprocessor 110 then makes, for example, a YES/NO decision as to whether or not a sufficiently high correlation with each reference pattern has been achieved.

If a satisfactory correlation has been made with only one reference pattern then this indicates that the pattern has been successfully read. All other outcomes indicate that the pack has not been successfully read. In the latter case, the conveyor belt 40 is moved to the position 41C and the pack is rejected into a reject bin 135. If the pack has been validly detected then the microprocessor 110 will decide whether to feed the pack to the double twisted band 46 or to the bypass conveyor 43. The pack is then fed to the third orientation device 22 which is identical with the device in FIGS. 1 and 2 and the microprocessor 110 will selectively control the position of the fingers 51 and 51A.

In the example described above, the conveyor belt 40 is movable between each of three positions 41A, 41B and 41C. In some cases, this will limit the speed of operation of the system, particularly bearing in mind the time needed to move the conveyor 40 from position 41C to position 41B.

Figure 8:
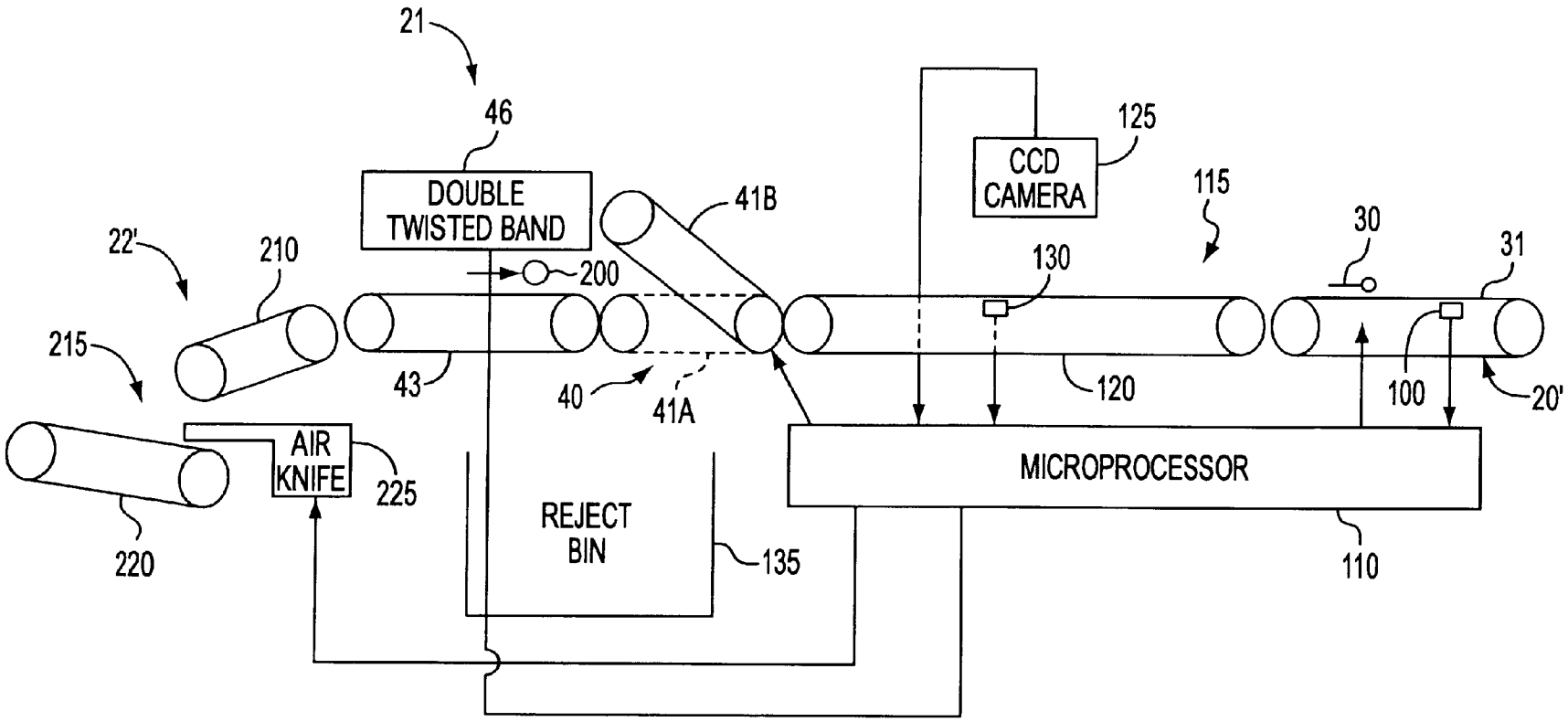
FIG. 8 is a plan view of an apparatus, according to an additional embodiment of the present invention.

Therefore, FIG. 8 is a plan view of an apparatus, according to an additional embodiment of the present invention. In FIG. 8, the conveyor 40 is only movable between positions 41A and 41B. An additional blower 200 opens to one side of the bypass conveyor 43. When a pack is not recognized, the conveyor 40 is arranged in its position 41A so that the pack is transferred to the bypass conveyor 43 and then the blower 200 is activated to blow the pack of the conveyor 43 into the reject bin 135. This modified approach can also be unitized with the example shown in FIGS. 1 and 2.

In FIG. 7, the third orientation device 22 is shown utilizing fingers 51 which can be moved up into the path of a pack so that the packs will be turned end to end. According to embodiments of the present invention, it has been found difficult to achieve that movement quickly enough for fast throughput operation. Also, the fingers 51 can damage the packs. Therefore, FIG. 8 illustrates an alternative third orientation device 22' which can be utilized, for example, in the embodiments of FIGS. 1, 2 or 7. In this case, packs from the second orientation device 21 are fed to a conveyor 210 which conveys them downwardly to a gap 215 across which they free fall onto a further conveyor 220 which corresponds, for example, to the conveyor 52 in FIG. 1. If a pack has to be turned end to end, an air knife 225 is activated to blow air across the air gap 215, to thereby flip the pack as it drops onto the lower conveyor 220. A sensor (not shown) should be provided to enable the timing of the actuation of the air knife 225 to be accurately controlled.

Therefore, according to above embodiments of the present invention, a method of orienting a flexible walled article comprises (a) presenting the article to a pattern detector and detecting a pattern on the surface of the article; (b) comparing the detected pattern with at least one of a number of predetermined patterns representing respective orientations of the article to identify the orientation of the presented article; and, (c) when the identified orientation is not a required orientation, turning the article in a manner dependent on the identified orientation, so that the article takes up the required orientation.

Further, according to the above embodiments of the present invention, an apparatus for orienting a flexible walled article comprises (a) a pattern detector for detecting a pattern on the surface of an article; (b) a mechanism for presenting the article to the pattern detector; (c) a processor for comparing the detected pattern with at least one of a number of predetermined patterns representing respective orientations of the article to identify the orientation of the presented article; and (d) an orientation system for, if necessary, turning the article in a manner dependent on the identified orientation so that the article takes up a required orientation.

Therefore, according to the above embodiments of the present invention, a pattern is automatically detected on a surface of a flexible walled article having a required orientation. The detected pattern is automatically compared with at least one predetermined pattern of a plurality of predetermined patterns representing respective orientations of the article, to identify the orientation of the article. When the identified orientation is not the required orientation, the article is automatically turned in a manner dependent on the identified orientation so that the article obtains the required orientation.

Further, according to the above embodiments of the present invention, an apparatus includes a pattern detector, a processor and an orientation system. The pattern detector detects a pattern on a surface of a flexible walled article having a required orientation. The processor compares the detected pattern with at least one of a number of predetermined patterns representing respective orientations of the article to identify the orientation of the article. When the identified orientation is not the required orientation, the orientation system automatically turns the article in a manner dependent on the identified orientation so that the article obtains the required orientation. The term "automatically" indicates that operations are performed in an automated, mechanized manner by a machine, as opposed to being performed by humans.

The various examples herein describe various scan rates, sampling rates, number of values included in each sample, conveyor belt run rates, sizes of data values, etc. However, these are just intended as examples, and, of course, the present invention is not limited to these.

Further, in the various examples described herein, a pack is described as having eight different orientations. However, the present invention is not limited to any specific number of orientations. Further, in the various embodiments of the present invention, a microprocessor is described as having a specific number of master tables containing a specific number of entries. However, the present invention is not limited to any specific number of tables or any specific number of entries. Moreover, the present invention is not limited to data being stored in "tables," and other suitable data structures may be appropriate.

In addition, in the various examples described herein, specific positioning of various elements is described herein. Of course, there are variants of such positioning which can be used to achieved the purpose of the invention, so that the present invention is not limited to the specific positioning described herein.

Thus, it should be understood that the various examples described herein can easily be modified by a person of ordinary skill in the art, and the present invention is not limited to the specific examples and values described herein. Moreover, although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A method of orienting a flexible walled article, comprising:

presenting the article to a pattern detector;

detecting a pattern on the surface of the article by the pattern detector;

comparing the detected pattern with at least one of a number of predetermined patterns representing respective orientations of the article to identify the orientation of the presented article; and, when the identified orientation is not a required orientation, turning the article in a manner dependent on the identified orientation so that the article takes up the required orientation.

2. A method according to claim 1, wherein the article is a pillow bag.

3. A method according to claim 1 wherein the article comprises a snack pack.

4. A method according to claim 2 wherein the article comprises a snack pack.

5. A method according to claim 1, wherein the article is made by a form fill sealing machine.

6. A method according to claim 2, wherein the article was made by a form fill sealing machine.

7. A method according to claim 1, wherein said comparing compares the detected pattern with four or eight predetermined patterns.

8. A method according to claim 2, wherein said comparing compares the detected pattern with four or eight predetermined patterns.

9. A method according to claim 1, wherein said presenting presents the article by moving the article past the pattern detector.

10. A method according to claim 2, wherein said presenting presents the article by moving the article past the pattern detector.

11. A method according to claim 1, wherein the pattern on the surface of the article is defined by appearance of a number of image areas along the presented surface of the article.

12. A method according to claim 2, wherein the pattern on the surface of the article is defined by appearance of a number of image areas along the presented surface of the article.

13. A method according to claim 1, wherein said presenting presents the article by moving the article in a direction of movement past the pattern detector, and the pattern on the surface of the article is defined by appearance of a number of image areas along the surface of the article and located along a line parallel with the direction of movement.

14. A method according to claim 11, wherein the appearance of each image area is defined by more than one channel of data, each channel representing a different characteristic of the appearance of the image area.

15. A method according to claim 13, wherein the appearance of each image area is defined by more than one channel of data, each channel representing a different characteristic of the appearance of the image area.

16. A method according to claim 14, wherein the data for each channel represents respective color components or contrast information.

17. A method according to claim 15, wherein the data for each channel represents respective color components or contrast information.

18. A method according to claim 14, wherein said comparing comprises comparing each channel with a corresponding channel of each predetermined pattern.

19. A method according to claim 17, wherein said comparing comprises comparing each channel with a corresponding channel of each predetermined pattern.

20. A method according to claim 18, wherein said comparing comprises:

determining the degree of similarity between a predetermined pattern and the detected pattern by determining the difference between the data for each image area of the detected pattern and the corresponding predetermined data for each channel, and summing the differences.

21. A method according to claim 20, said comparing further comprising:

comparing the summed difference for each predetermined pattern and identifying the predetermined pattern corresponding to the lowest sum.

22. A method according to claim 20, further comprising:

offsetting the predetermined data for a predetermined pattern relative to the data for the detected pattern prior to said comparing the detected pattern, so as to temporally align the predetermined data of the predetermined pattern and the data for the detected pattern.

23. A method according to claim 21, further comprising:

offsetting the predetermined data for a predetermined pattern relative to the data for the detected pattern prior to said comparing the detected pattern, so as to temporally align the predetermined data of the predetermined pattern and the data for the detected pattern.

24. A method according to claim 22, wherein said offsetting comprises:

offsetting the predetermined data for at least one channel relative to the corresponding data for the detected pattern by different amounts, determining a sum of the differences between data sets at each offset, and selecting the offset corresponding to the smallest difference sum.

25. A method according to claim 1, wherein said turning is carried out at spaced locations.

26. A method according to claim 1, wherein said turning comprises:

performing at least one of the group consisting of a lateral rotation, an end to end rotation, and a side to side rotation and a twist.

27. A method according to claim 26, further comprising:

moving the article substantially continuously past the detector and locations at which said turning is performed.

28. Apparatus comprising:

a pattern detector detecting a pattern on a surface of a flexible walled article presented to the pattern detector;

a processor comparing the detected pattern with at least one of a number of predetermined patterns representing respective orientations of the article to identify the orientation of the presented article; and an orientation system turning, when required, the article in a manner dependent on the identified orientation so that the article takes up a required orientation.

29. Apparatus according to claim 28, wherein the orientation system comprises:

an orientation device imparting a 90° lateral rotation to the article.

30. Apparatus according to claim 28, wherein the orientation system comprises:

an orientation device imparting a 180° side to side rotation to the article.

31. Apparatus according to claim 29, wherein the orientation system comprises:

an orientation device imparting a 180° side to side rotation to the article.

32. Apparatus according to claim 30, wherein the orientation device imparting a 180° side to side rotation comprises a double twisted band.

33. Apparatus according to claim 31, wherein the orientation device imparting a 180° side to side rotation comprises a double twisted band.

34. Apparatus according to claim 30, further comprising:

a bypass path past the orientation device; and a diverter operable to feed the article either to the orientation device or to the bypass path.

35. Apparatus according to claim 31, further comprising:

a bypass path past the orientation device imparting a 180° side to side rotation; and a diverter operable to feed the article either to the orientation device imparting a 180° side to side rotation or to the bypass bath.

36. Apparatus according to claim 28, wherein the orientation system comprises:

an orientation device for imparting a 180° end to end rotation.

37. Apparatus according to claim 29, wherein the orientation system comprises:

an orientation device for imparting a 180° end to end rotation.

38. Apparatus according to claim 30, wherein the orientation system comprises:

an orientation device imparting a 180° end to end rotation.

39. Apparatus according to claim 31, wherein the orientation system comprises:

an orientation device imparting a 180° end to end rotation.

40. Apparatus according to claim 36, wherein the orientation device imparting a 180° end to end rotation comprises:

an article conveyor;

a selectively operable abutment which can be positioned in the path of the article on the conveyor; and an actuator lifting the article over the abutment to effect an end to end rotation.

41. Apparatus according to claim 37, wherein the orientation device imparting a 180° end to end rotation comprises:

an article conveyor;

a selectively operable abutment which can be positioned in the path of the article on the conveyor; and an actuator lifting the article over the abutment to effect an end to end rotation.

42. Apparatus according to claim 38, wherein the orientation device imparting a 180° end to end rotation comprises:

an article conveyor;

a selectively operable abutment which can be positioned in the path of the article on the conveyor; and an actuator lifting the article over the abutment to effect an end to end rotation.

43. An apparatus according to claim 37, wherein the orientation device imparting a 90° lateral rotation to the article and the orientation device imparting a 180° end to end rotation are selectively operable.

44. An apparatus according to claim 39, wherein the orientation device imparting a 90° lateral rotation to the article and the orientation device imparting a 180° end to end rotation are selectively operable.

45. An apparatus according to claim 35, further comprising:

a blower selectively actuable to blow rejected articles off the bypass path.

46. An apparatus according to claim 39, wherein the orientation device imparting a 180° end to end rotation defines a feed path including a gap across which articles drop in use, and an air knife selectively operable to turn articles as they drop across the gap.

47. An apparatus as in claim 28, wherein the pattern detector comprises a CCD camera.

48. A method comprising:

automatically detecting a pattern on a surface of a flexible walled article having a required orientation;

automatically comparing the detected pattern with at least one predetermined pattern of a plurality of predetermined patterns representing respective orientations of the article, to identify the orientation of the article; and, when the identified orientation is not the required orientation, automatically turning the article in a manner dependent on the identified orientation so that the article obtains the required orientation.

49. A method according to claim 48, wherein the article is a pillow bag.

50. An apparatus comprising:

a detector automatically detecting a pattern on a surface of a flexible walled article having a required orientation;

means for automatically comparing the detected pattern with at least one predetermined pattern of a plurality of predetermined patterns representing respective orientations of the article, to identify the orientation of the article; and means, when the identified orientation is not the required orientation, for automatically turning the article in a manner dependent on the identified orientation so that the article obtains the required orientation.

51. Apparatus comprising:

a pattern detector detecting a pattern on a surface of a flexible walled article, the article having a required orientation;

a processor comparing the detected pattern with at least one of a number of predetermined patterns representing respective orientations of the article to identify the orientation of the article; and an orientation system, when the identified orientation is not the required orientation, automatically turning the article in a manner dependent on the identified orientation so that the article obtains the required orientation.

52. Apparatus according to claim 51, wherein the orientation system comprises:

an orientation device automatically imparting a 90° lateral rotation to the article when the identified pattern indicates that the article should be so rotated to obtain the required orientation.

53. Apparatus according to claim 51, wherein the orientation system comprises:

an orientation device automatically imparting a 180° side to side rotation to the article when the identified pattern indicates that the article should be so rotated to obtain the required orientation.

54. Apparatus according to claim 52, wherein the orientation system comprises:

an orientation device automatically imparting a 180° side to side rotation to the article when the identified pattern indicates that the article should be so rotated to obtain the required orientation.

55. Apparatus according to claim 51, wherein the orientation system comprises:

an orientation device automatically imparting a 180° end to end rotation when the identified pattern indicates that the article should be so rotated to obtain the required orientation.

56. Apparatus according to claim 52, wherein the orientation system comprises:

an orientation device automatically imparting a 180° end to end rotation when the identified pattern indicates that the article should be so rotated to obtain the required orientation.

57. Apparatus according to claim 53, wherein the orientation system comprises:

an orientation device automatically imparting a 180° end to end rotation when the identified pattern indicates that the article should be so rotated to obtain the required orientation.

58. Apparatus according to claim 54, wherein the orientation system comprises:

an orientation device automatically imparting a 180° end to end rotation when the identified pattern indicates that the article should be so rotated to obtain the required orientation.

59. Apparatus according to claim 58, further comprising:

a bypass path past the orientation device imparting a 180° side to side rotation; and a diverter selectively operable in accordance with the identified orientation to feed the article either to the orientation device imparting a 180° side to side rotation or to the bypass path.

* * * * *